US005620515A

United States Patent [19]

Takahashi et al.

[11] Patent Number: 5,620,515

[45] Date of Patent: Apr. 15, 1997

[54] COATING APPARATUS

[75] Inventors: Susumu Takahashi; Hirofumi Yamamoto; Haruhiro Iida, all of Osaka, Japan

[73] Assignee: Inoue Kinzoku Kogyo Co., Ltd., Osaka, Japan

[21] Appl. No.: 454,597

[22] Filed: May 30, 1995

[51] Int. Cl.[6] ..... B05C 1/08

[52] U.S. Cl. ..... 118/258; 118/235; 118/244; 118/249; 118/262

[58] Field of Search ..... 118/200, 203, 118/234, 244, 249, 258, 262, 235

[56] References Cited

U.S. PATENT DOCUMENTS

| | | | |
|---|---|---|---|
| 3,647,525 | 3/1972 | Dahlgren | 117/111 |
| 3,875,581 | 4/1975 | Yamashita et al. | 354/318 |
| 4,211,167 | 7/1980 | Corse | 101/148 |
| 4,471,714 | 9/1984 | Esser | 118/126 |
| 5,255,539 | 10/1993 | Zimmer | 68/43 |
| 5,466,292 | 11/1995 | Kustermann | 118/257 |

*Primary Examiner*—Jill Warden
*Assistant Examiner*—Long V. Le
*Attorney, Agent, or Firm*—Wenderoth, Lind & Ponack

[57] ABSTRACT

A coating apparatus comprises a carrier movable in a to-and-aft direction, a swing frame having a portion pivotably supported by the carrier, three pairs of bearings mounted to the swing frame, and three rolls journaled by the three pair of bearings, respectively. A drive unit includes three variable speed motors which include respective output shafts connected to the corresponding rolls through offset shaft couplings. The three rolls have respective axes which are connected to form an imaginary triangle. That portion of the swing frame which is pivotably supported by the carrier is located outside of the imaginary triangle. The imaginary triangle is moved back and forth when the swing frame is swung back and forth. The carrier is reciprocated to accommodate the reciprocating movement of the imaginary triangle. Thus, the imaginary triangle can be rotated to a desired coating position so far as the amount of offset between the rolls and the output shafts is within the allowable offset range of the offset shaft couplings.

6 Claims, 12 Drawing Sheets

COATING APPARATUS

BACKGROUND OF THE INVENTION

1. Field of the Invention

The present invention generally relates to coating apparatus used to apply synthetic resin, bonding or other agents to a web of sheet material such as paper and plastic film and more particularly, to an improved coating apparatus which enables rapid and ready change of coating methods such as a bottom reverse coating method and a top reverse coating method.

2. Description of the Related Art

FIGS. 12(A) and 12(B) schematically show typical coating methods by the use of three rolls B, C and M. Such methods include a bottom reverse coating method used to apply a low viscosity coating agent (see FIG. 12(A)), and a top reverse coating method used to apply a high viscosity coating agent (see FIG. 12(B)). The reference sign T designates an imaginary triangle which connects the axes of the three rolls B, C and M. In the bottom reverse coating method, the imaginary triangle is in a normal position, whereas in the top reverse coating method, the imaginary triangle T is in an inverted position. Thus, the imaginary triangle is rotated at an angle of about 40 to 45 degrees when a change of these methods takes place. The rolls B and M need be moved away from and toward the roll C. When the rolls B and M are moved toward the roll C to apply a coating agent, a required space must be kept between the rolls B and M and the roll C. In FIGS. 12(A) and 12(B), the reference signs A and S designate a coating agent and a web of sheet material, respectively.

However, no mechanism has heretofore been proposed to change the position of bearings for the rolls B and M so as to rotate the imaginary triangle T by an angle of about 40 to 45 degrees. To that end, a plurality of separate coating apparatus need be provided to perform various coating methods so as to apply coating agents having different viscosities or other properties.

The provision of separate coating apparatus is costly and consumes substantial floor space. Accordingly, it is an object of the present invention to overcome these problems and provide a coating apparatus which can readily and rapidly change the orientation of an imaginary triangle which connects the axes of three rolls, in response to types of coating agents.

SUMMARY OF THE INVENTION

According to a first feature of the present invention, there is provided a coating apparatus which comprises three pairs of bearings having respective axes which are connected to provide an imaginary triangle, three rolls journaled by the pairs of corresponding bearings, drive means having three output shafts at predetermined locations, and three offset shaft couplings for connecting the three rolls to the corresponding three output shafts, wherein the three pairs of bearings are mounted to a swing frame, and the swing frame has a portion located outside of the imaginary triangle, the portion of the swing frame being journaled by a movable frame, and the movable frame being movable in a to-and-aft direction, and wherein the imaginary triangle can be rotated so far as the amount of offset between the rolls and the output shafts is within an allowable offset range of the offset shaft couplings.

A portion of the swing frame is located outside of the imaginary triangle and journaled by the movable frame. This arrangement permits the swing frame to be swung without interfering with the offset shaft couplings which in turn, provide a connection between the rolls and the output shafts. The imaginary triangle is moved rearward and forward when the swing frame is swung back and forth. Advantageously, the reciprocating movement of the imaginary triangle can be accommodated by reciprocating motion of the movable frame. As such, the imaginary triangle can be rotated to such a position as to carry out a desired coating method so far as the amount of offset between the rolls and the output shafts is within the allowable offset range of the offset shaft couplings.

In a preferred embodiment, the movable frame is moved in a transverse direction. This arrangement allows the rolls to be disconnected from the offset shaft couplings and thus, the output shafts and enables ready replacement of rolls.

According to a second feature of the present invention, there is provided a coating apparatus which comprises three pairs of bearings having respective axes which are connected to provide an imaginary triangle, three rolls journaled by the pairs of corresponding bearings, drive means having three output shafts at predetermined locations, and three offset shaft couplings for connecting the three rolls to the corresponding three output shafts, wherein the three pairs of bearings are mounted to a swing frame, and the swing frame has a portion located outside of the imaginary triangle, the portion of the swing frame being journaled by sliders, and the sliders being reciprocatingly mounted to a support frame, and wherein the imaginary triangle can be rotated so far as the amount of offset between the rolls and the corresponding output shafts is within an allowable offset range of the offset shaft couplings.

A portion of the swing frame is located outside of the imaginary triangle and journaled by the sliders. This arrangement permits the swing frame to be swung without interfering with the offset shaft couplings which in turn, provide a connection between the rolls and the output shafts. The imaginary triangle is moved rearward and forward when the swing frame is swung back and forth. Advantageously, the reciprocating movement of the imaginary triangle can be accommodated by reciprocating movement of the sliders. As such, the imaginary triangle can be rotated to such a position as to carry out a desired coating method so far as the amount of offset between the rolls and the output shafts is within the allowable offset range of the offset shaft couplings.

In a preferred embodiment, the support frame is moved in a transverse direction. This arrangement allows the rolls to be disconnected from the offset shaft couplings and thus, the output shafts and enables ready replacement of rolls.

According to a third feature of the present invention, there is provided a coating apparatus which comprises three pairs of bearings having respective axes which are connected to provide an imaginary triangle, three rolls journaled by the pairs of corresponding bearings, drive means having three output shafts at predetermined locations, and three offset shaft couplings for connecting the three rolls to the corresponding three output shafts, wherein the three pairs of bearings are mounted to a swing frame, wherein the swing frame has a portion located outside of the imaginary triangle, the portion of the swing frame being pivotally connected to one ends of swing levers, and the other end of the swing levers being pivotally connected to a support frame, and wherein the imaginary triangle can be rotated so far as the amount of offset between the rolls and the corresponding output shafts is within an allowable offset range of the offset shaft couplings.

portion of the swing frame is located outside of the imaginary triangle and is pivotally connected to the one ends of the swing levers. This arrangement permits the swing frame to be swung without interfering with the offset shaft couplings which in turn, provide a connection between the rolls and the output shafts. The imaginary triangle is moved rearward and forward when the swing frame is swung back and forth. Advantageously, the reciprocating movement of the imaginary triangle can be accommodated by pivotal motion of the swing levers. As such, the imaginary triangle can be rotated to such a position as to carry out a desired coating method so far as the amount of offset between the rolls and the output shafts is within the allowable offset range of the offset shaft couplings.

In a preferred embodiment, the support frame is moved in a transverse direction. This arrangement allows the rolls to be disconnected from the offset shaft couplings and thus, the output shafts and enables ready replacement of rolls.

BRIEF DESCRIPTION OF THE DRAWINGS

The present invention will now be described by way of example with reference to the accompanying drawings, in which.

DESCRIPTION OF THE PREFERRED EMBODIMENTS (First embodiment)

Figure 1:
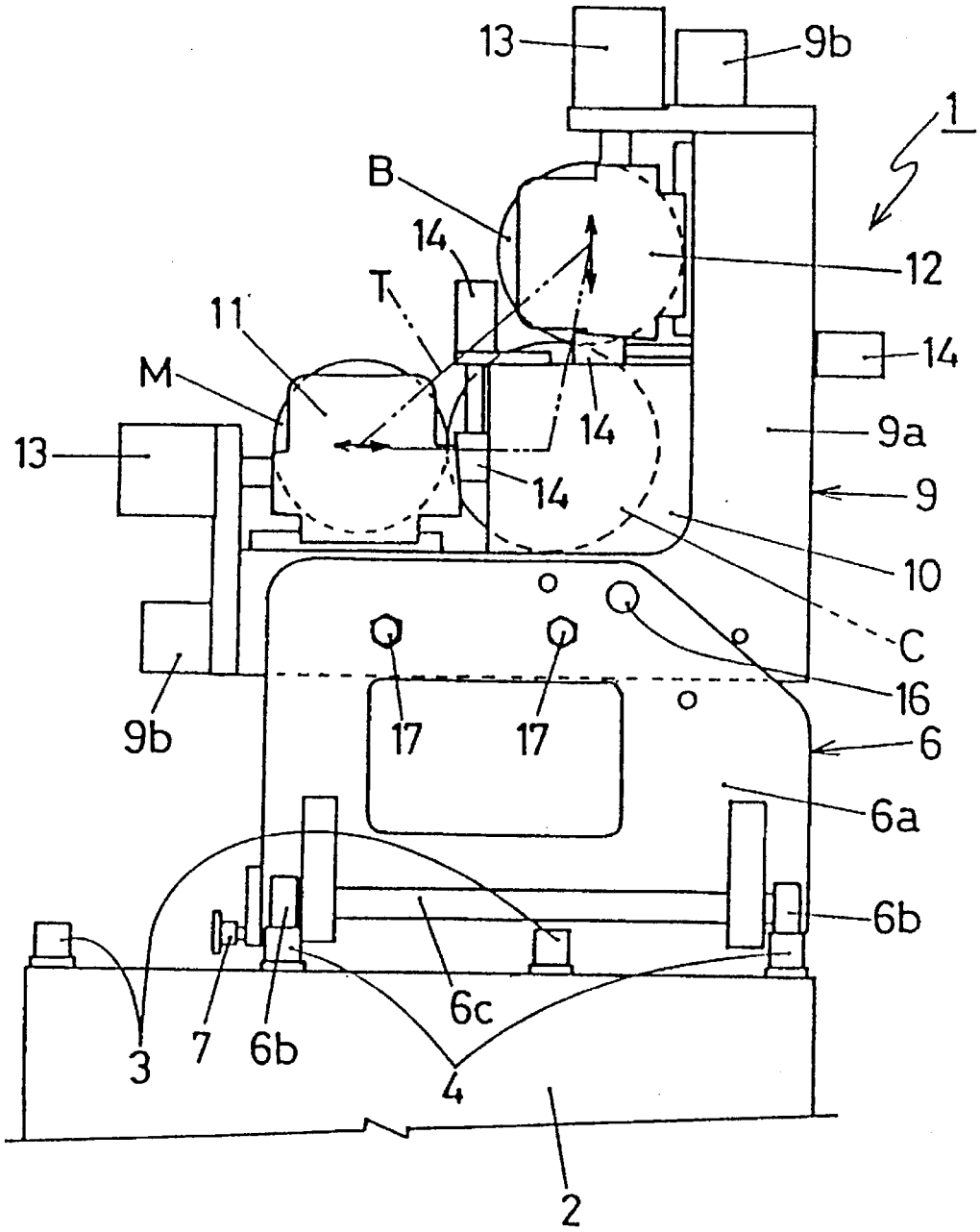
FIG. 1 is a right side view of a coating apparatus according to a first embodiment of the present invention with an imaginary triangle T in a normal position.
Figure 2:
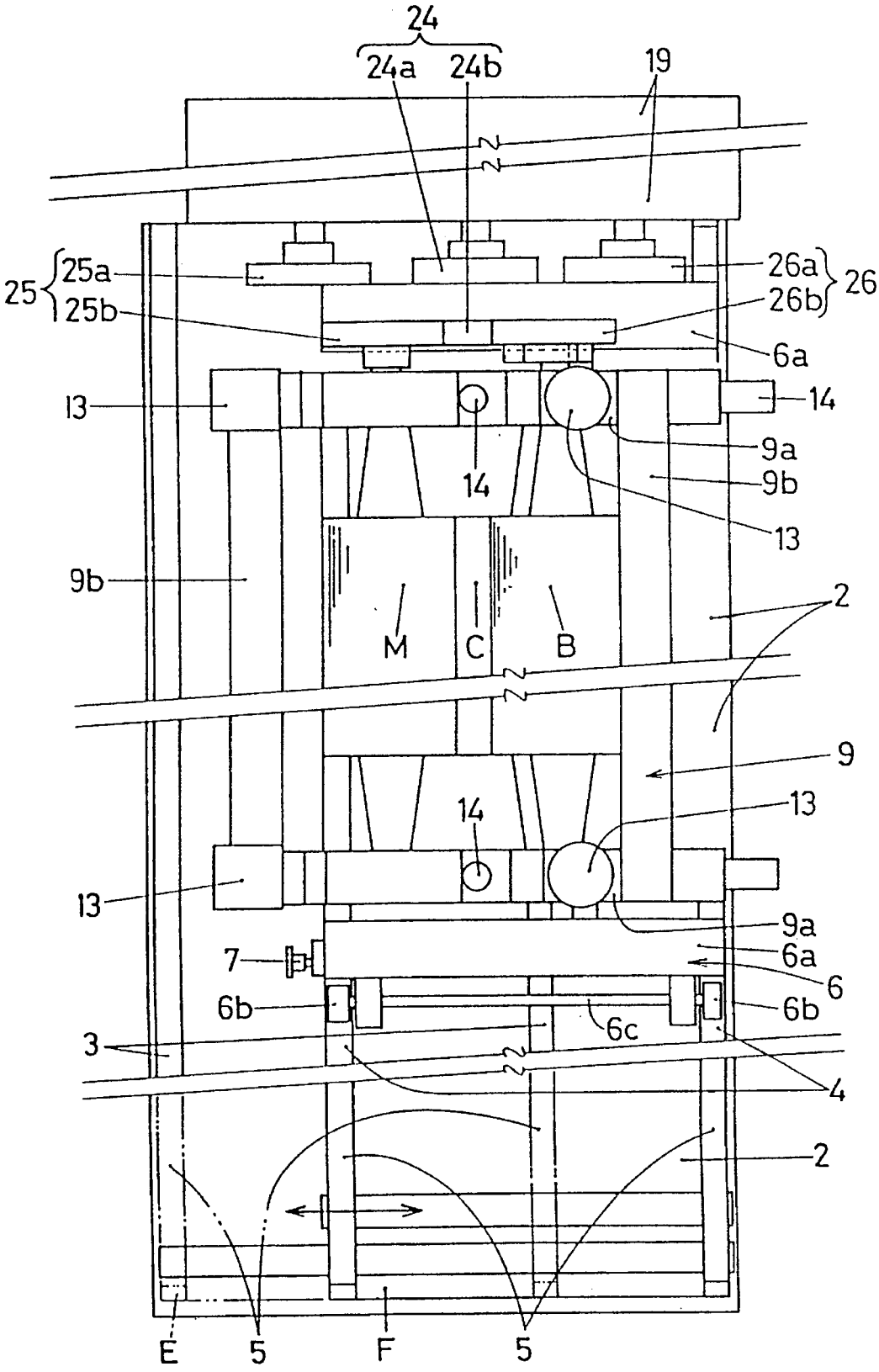
FIG. 2 is a plan view of the coating apparatus shown in FIG. 1 with part removed for clarity.
Figure 3:
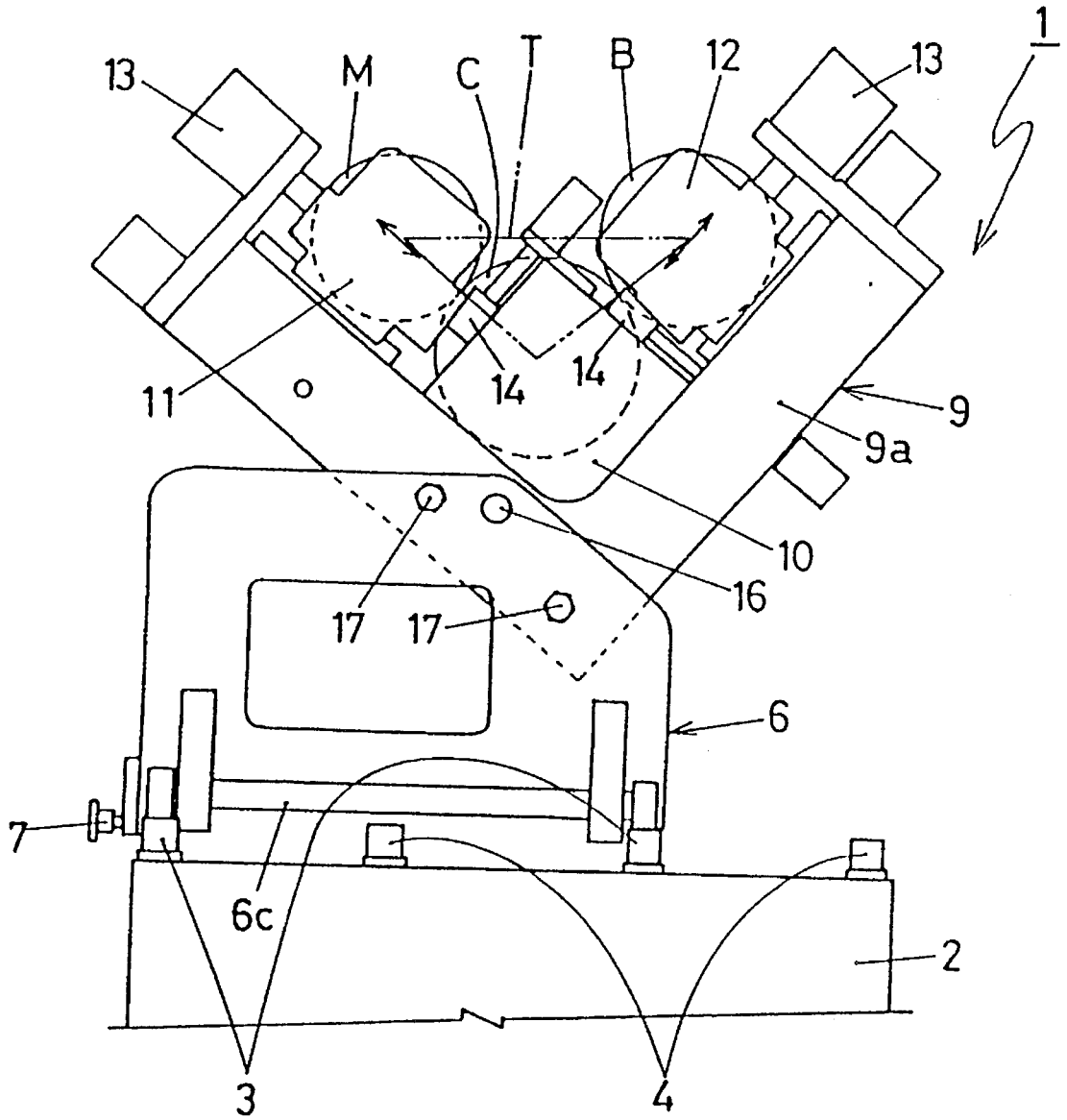
FIG. 3 is a right side view of the coating apparatus shown in FIG. 1, with the imaginary triangle T in an inverted position.
Figure 4:
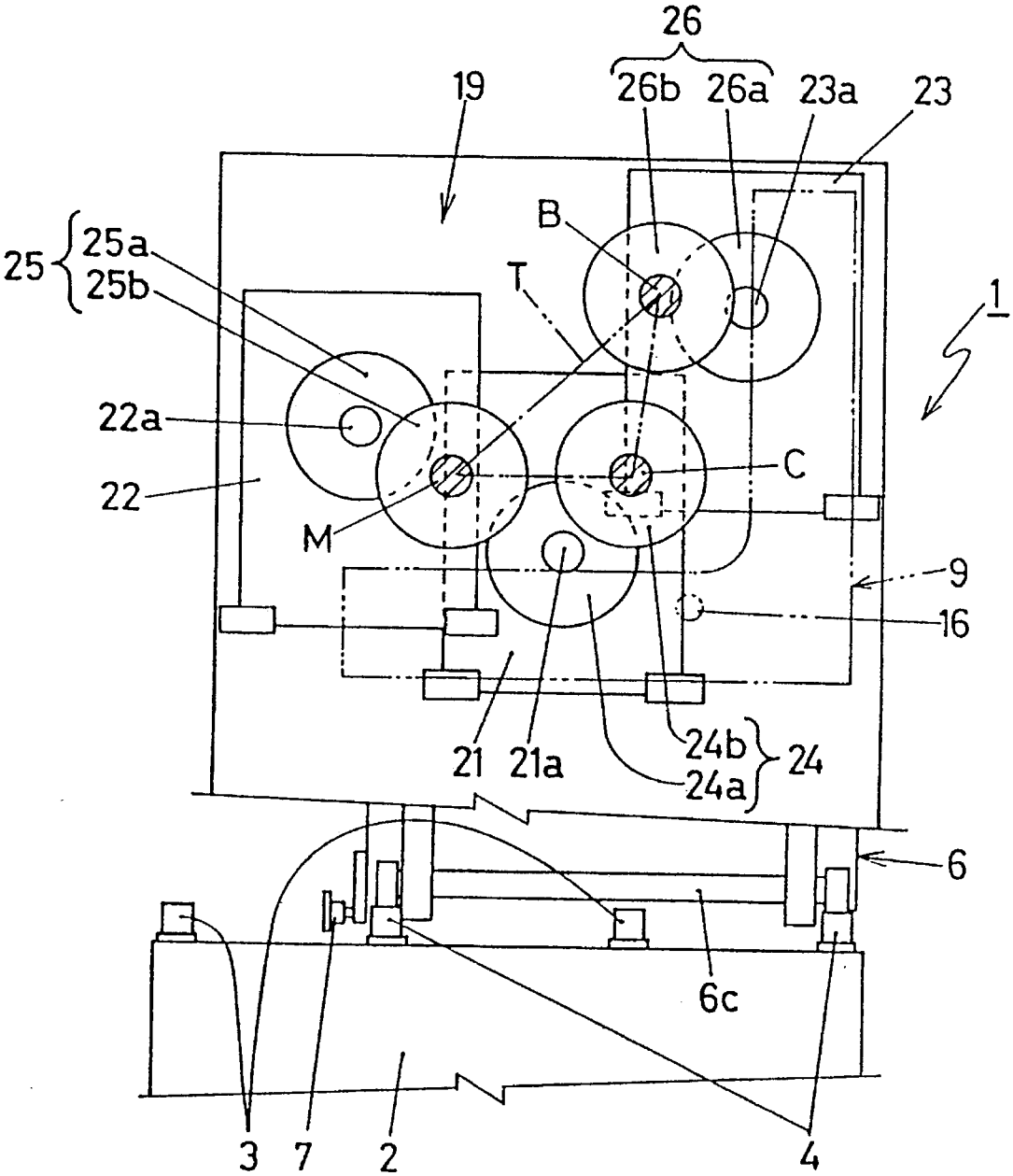
FIG. 4 shows the relationship between the axes of rolls and the output shafts of drive units when the imaginary triangle T is in its normal position.
Figure 5:
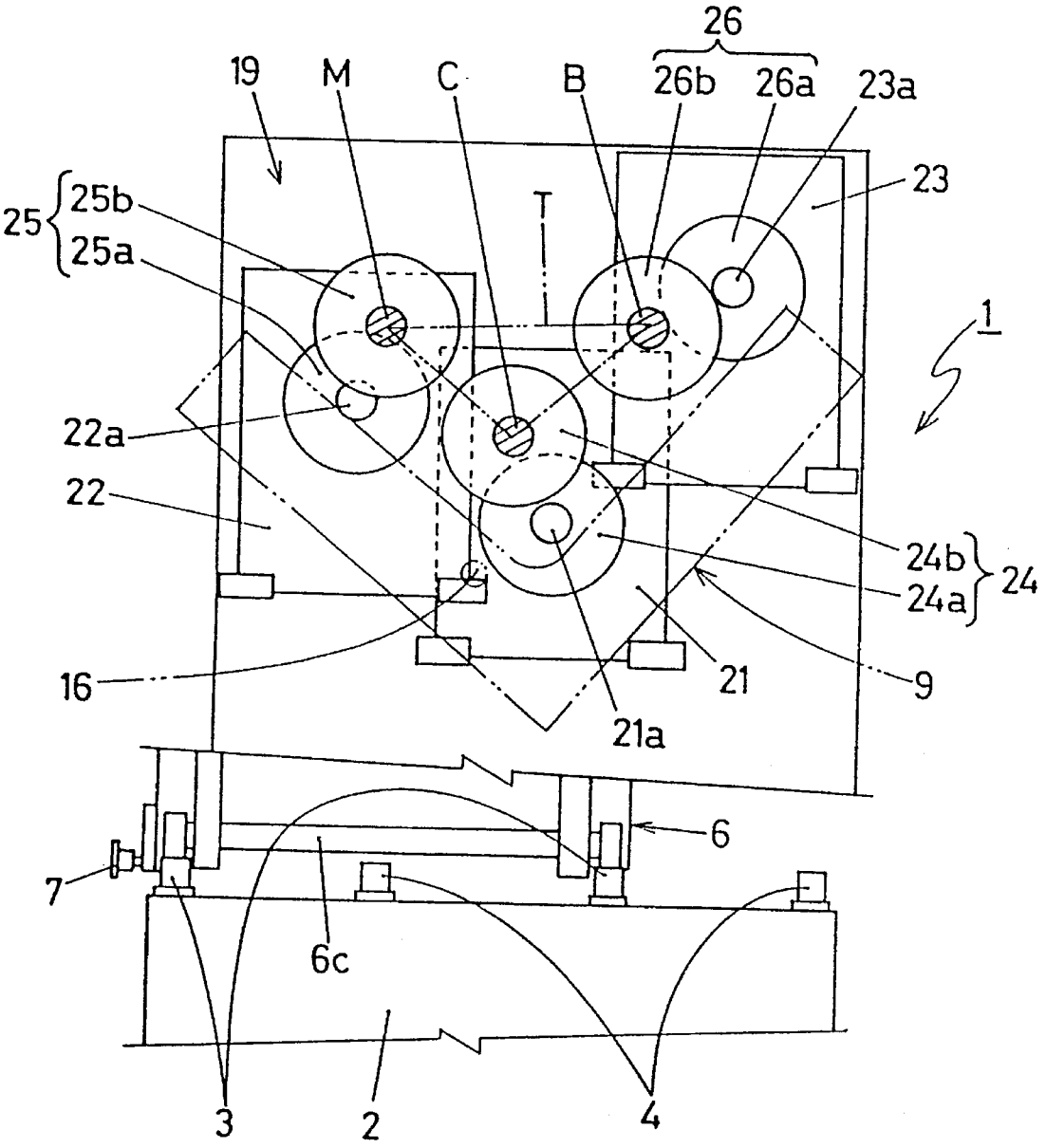
FIG. 5 shows the relationship between the axes of the rolls and the output shafts of the drive units when the imaginary triangle T is in its inverted position.

FIGS. 1 to 7 show a coating apparatus according to a first embodiment of the present invention. FIG. 1 is a right side view of the coating apparatus with an imaginary triangle T in a normal position. FIG. 2 is a plan view of the coating apparatus with part removed for clarity. FIG. 3 is a view similar to FIG. 1, but with the imaginary triangle T in an inverted position. FIG. 4 shows the relationship between the axes of rolls and output shafts when the imaginary triangle T is in its normal position. FIG. 5 is a view similar to FIG. 4, but with the imaginary triangle T in its inverted position. FIG. 6 schematically illustrates various coating methods when the imaginary triangle T is in its normal position. FIG. 7 schematically illustrates various coating methods when the imaginary triangle T is in its inverted position. In the illustrated embodiment, the terms "forward" and "rearward" are to the left and right in FIGS. 1 and 2, respectively. Also, the terms "rightward" and "leftward" are to the bottom and top in FIGS. 1 and 2, respectively.

A coating apparatus 1 according to the first embodiment comprises a base frame 2, and two pairs of fixed rails 3 and 4 arranged one after the other on the base frame 2 and extending laterally of the base frame 2. Also, a pair of movable rails 5 are arranged on the base frame 2 rightwardly of the rails 3 and 4 and movable in a to-and-aft direction. The movable rails 5 are manually or automatically moved between a position (shown by a broken line E in FIG. 2) where the movable rails 5 can be connected to the front pair of fixed rails 3 and a position (shown by a solid line F in FIG. 2) where the movable rails 5 can be connected to the rear pair of fixed rails 4.

A movable frame or carrier 6 is movable along the fixed rails 3 and 4 and the movable rails 5. The carrier 6 includes right and left side frames 6*a* and 6*a*. The side frames 6*a* and 6*a* are interconnected by connecting frames (not shown) so as to provide a rigid structure. An axle 6*c* is provided with a pair of wheels 6*b* and 6*b* and rotatably supported by each side frame 6*a*. A suitable number of locking means 7 are provided to fix the carrier 6 in a given coating position on the fixed rails 3 or 4.

In order to move the carrier 6 from a rear coating position to a front coating position, each of the locking means 7 is first released to allow the carrier 6 to be moved to the right from the rear coating position shown in FIG. 2. After the carrier 6 has been transferred from the rear pair of fixed rails 4 to the movable rails 5, the carrier 6 is moved forward with the movable rails 5. When the movable rails 5 are brought into alignment with the front pair of fixed rails 4, the carrier 6 is moved to the left and then, transferred to the front pair of fixed rails 3. Finally, each of the locking means 7 is operated to lock the carrier 6 in the front coating position. Although not shown, the carrier 6 may be reciprocated directly between the rear and front coating positions, with no rightward movement involved.

As can be seen from the left side, an L-shaped swing frame assembly 9 is rotatably mounted to the carrier 6. The swing frame assembly 9 comprises a pair of right and left side frames 9*a* and 9*a*. These side frames 9*a* and 9*a* are interconnected by connecting frames 9*b* and 9*b* to provide a rigid structure. A pair of bearings 10 are fixed to the inner corners of the side frames 9*a* and 9*a*, respectively. Another pair of bearings 11 are movable in a to-and-aft direction. Also, a pair of bearings 12 are movable in a vertical direction. The three pairs of bearings 10, 11 and 12 are each separable so as to allow replacement of respective rolls C, M and B.

Actuators 13 and 13 such as air cylinders are mounted to each side frame 9*a* of the swing frame assembly 9 so as to move the bearings 11 and 12. The bearings 11 and 12 can be moved within a range between about 30 and 60 mm. Disposed between the rolls 10 and 11 and between the rolls 10 and 12 are means 14, such as taper cotter, for adjusting clearances.

The right and left side frames 9*a* and 9*a* of the swing frame assembly 9 are mounted to the carrier 6 for swing movement about a pivot 16. The three bearings 10, 11 and 12 have center axes connected together to provide (i.e. to define apexes of) an imaginary triangle as designated by the reference sign T. The swing frame assembly 9 can be swung between a position where the imaginary triangle T is in its normal position as shown in FIG. 1 and a position where the imaginary triangle is in its inverted position as shown in FIG. 3. Bolts or similar fastening means 17 and 17 are used to lock the swing frame assembly 9 in either of these positions. If necessary, a stopper (not shown) may be disposed between the swing frame assembly 9 and the carrier 6 to limit swing motion of the swing frame assembly 9.

A portion of the swing frame assembly 9 which is pivotally mounted as at 16 to the carrier 6 is located outside of the imaginary triangle T. The carrier 6 is moved rearward and forward when the swing frame assembly 9 is swung back and forth. This arrangement enables the amount of offset between the axes of the rolls C, M and B and output shafts 21*a*, 22*a* and 23*a* (see FIGS. 4 and 5), which will later be described, to fall within the allowable offset range of the offset shaft couplings 24, 25 and 26.

Referring to FIGS. 2, 4 and 5, a drive unit 19 is provided at the left side of the base frame 2 and comprises three variable speed motors 21, 22 and 23 so as to independently drive the rolls C, M and B. The variable speed motors 21, 22 and 23 each have speed reducers and include output shafts 21*a*, 22*a* and 23*a*, respectively. The output shafts 21*a*, 22*a* and 23*a* are connected to the rolls C, M and B by respective offset shaft couplings 24, 25, 26 such as Schmidt couplings and constant velocity ball joints. In the illustrated embodiment, the offset shaft couplings 24, 25 and 26 are Schmidt couplings and include drive disks 24*a*, 25*a* and 26*a*, and driven disks 24*b*, 25*b* and 26*b*, respectively. The shafts of the rolls C. M and B are detachable from the offset shaft couplings 24, 25 and 26 so as to permit replacement of rolls and pulling of the carrier 6.

Again, a portion of the swing frame assembly 9 which is journaled by the carrier 6 is located outside of the imaginary triangle T. This advantageously allows the swing frame assembly 9 to be swung without interfering with the offset shaft couplings 24, 25 and 26 which provide a connection between the rolls C, M and B and the output shafts 21*a*, 22*a* and 23*a*. The imaginary triangle T is moved back and forth when the swing frame assembly 9 is swung back and forth. This reciprocating movement of the imaginary triangle T can be accommodated by the reciprocating movement of the carrier 6. Thus, the imaginary triangle T can be rotated from the normal position shown in FIG. 1 to the inverted position shown in FIG. 3 so far as the amount of offset between the axes of the rolls C, M and B and the respective output shafts 21*a*, 22*a* and 23*a* is within the allowable offset range of the offset shaft couplings 24, 25 and 26.

Figure 6A:
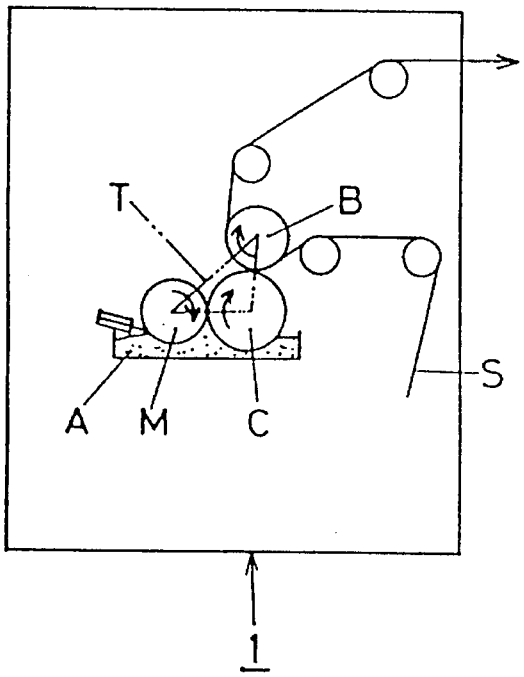
FIGS. 6(A) to 6(C) schematically illustrate various coating methods which can be performed with the imaginary triangle T in its normal position.
Figure 6B:
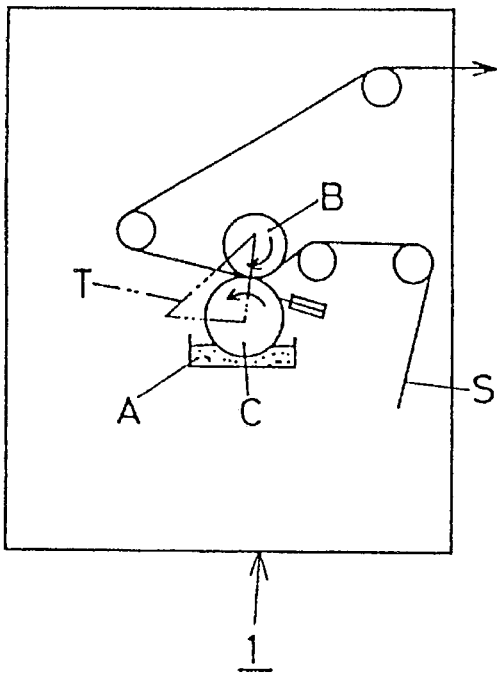
Figure 6C:
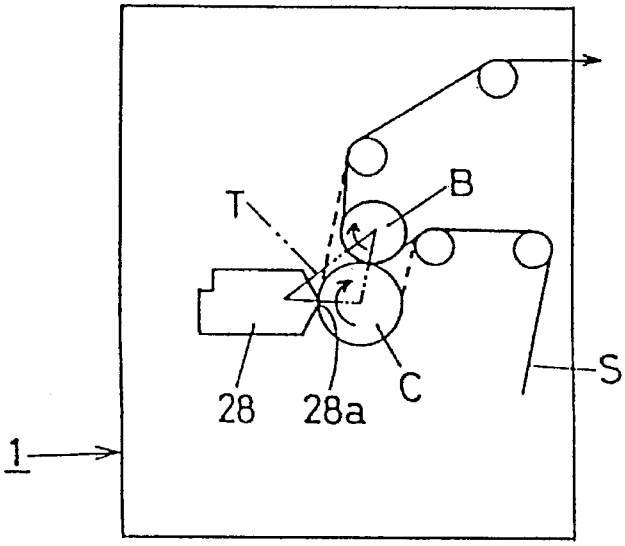

FIG. 6 shows various coating methods which can be performed by the coating apparatus 1 of the present invention with the imaginary triangle T in its normal position. FIGS. 6(A), 6(B) and 6(C) illustrate a bottom reverse coating method, a direct gravure coating method, and a die reverse coating method, respectively. In the direct gravure coating method shown in FIG. 6(B), no roll is mounted to the right and left bearings 11 (see FIG. 1). In the die reverse coating method shown in FIG. 6(C), a pair of die heads 28 are associated with the right and left bearings 11 (see FIG. 1) and include slits 28*a*. A coating agent is applied to the roll C through the slits 28*a* of the die heads 28. At this time, the right and left bearings 11 are disconnected from the offset shaft couplings 25 so as to prevent rotation of the die heads 28. Although not shown, other coating methods which can be performed with the imaginary triangle T in its normal position include a reverse gravure coating method, a direct die coating method, a fountain reverse coating method, and a kiss mayer-bar coating method.

Figure 7A:
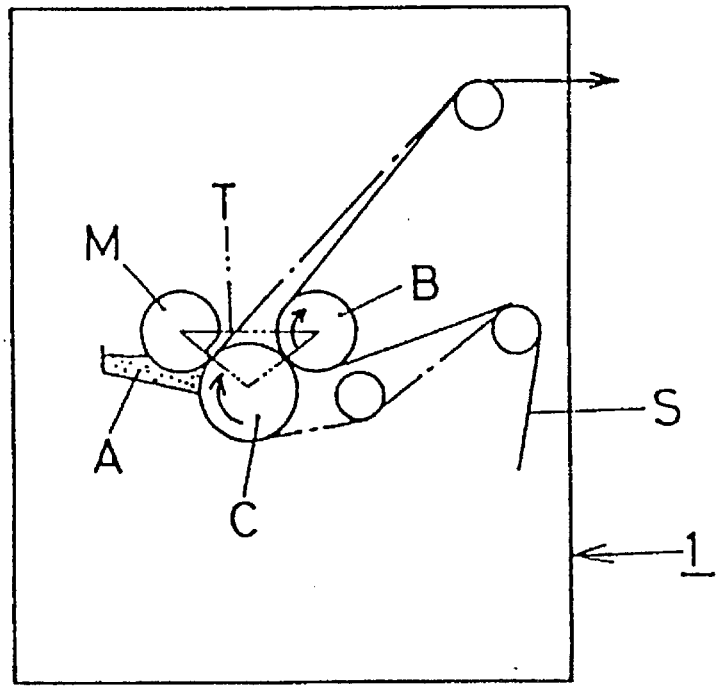
FIGS. 7(A) and 7(B) schematically illustrate various coating methods which can be performed with the imaginary triangle T in its inverted position.
Figure 7B:
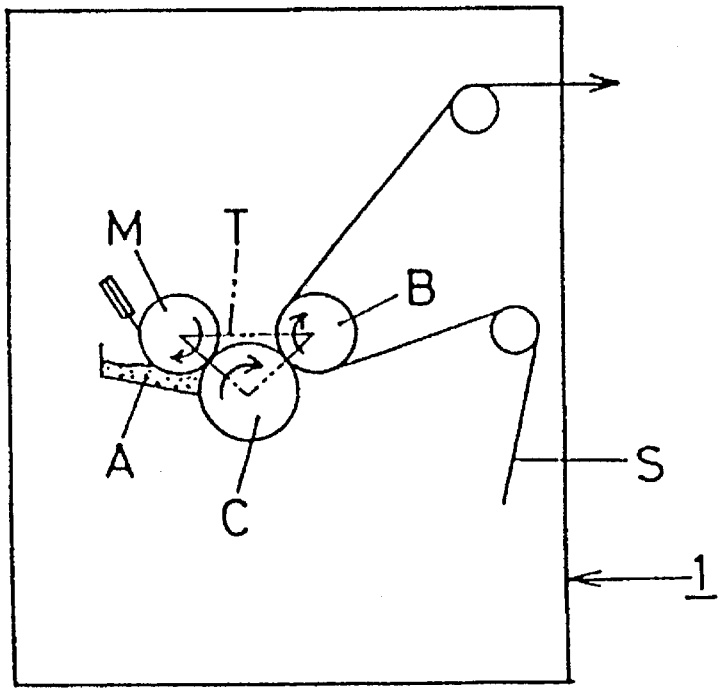

FIG. 7 shows various coating methods which can be performed by the coating apparatus 1 of the present invention with the imaginary triangle T in its inverted position. FIG. 7(A) illustrates a bar reverse coating method (shown by a solid line) or a bar direct coating method (shown by a broken line). FIG. 7(B) illustrates a top reverse coating method. In the bar reverse coating method or the bar direct coating method shown in FIG. 7(A), a pair of metering bars are associated with the right and left bearings 11 (see FIG. 1).

(Second embodiment)

Figure 8:
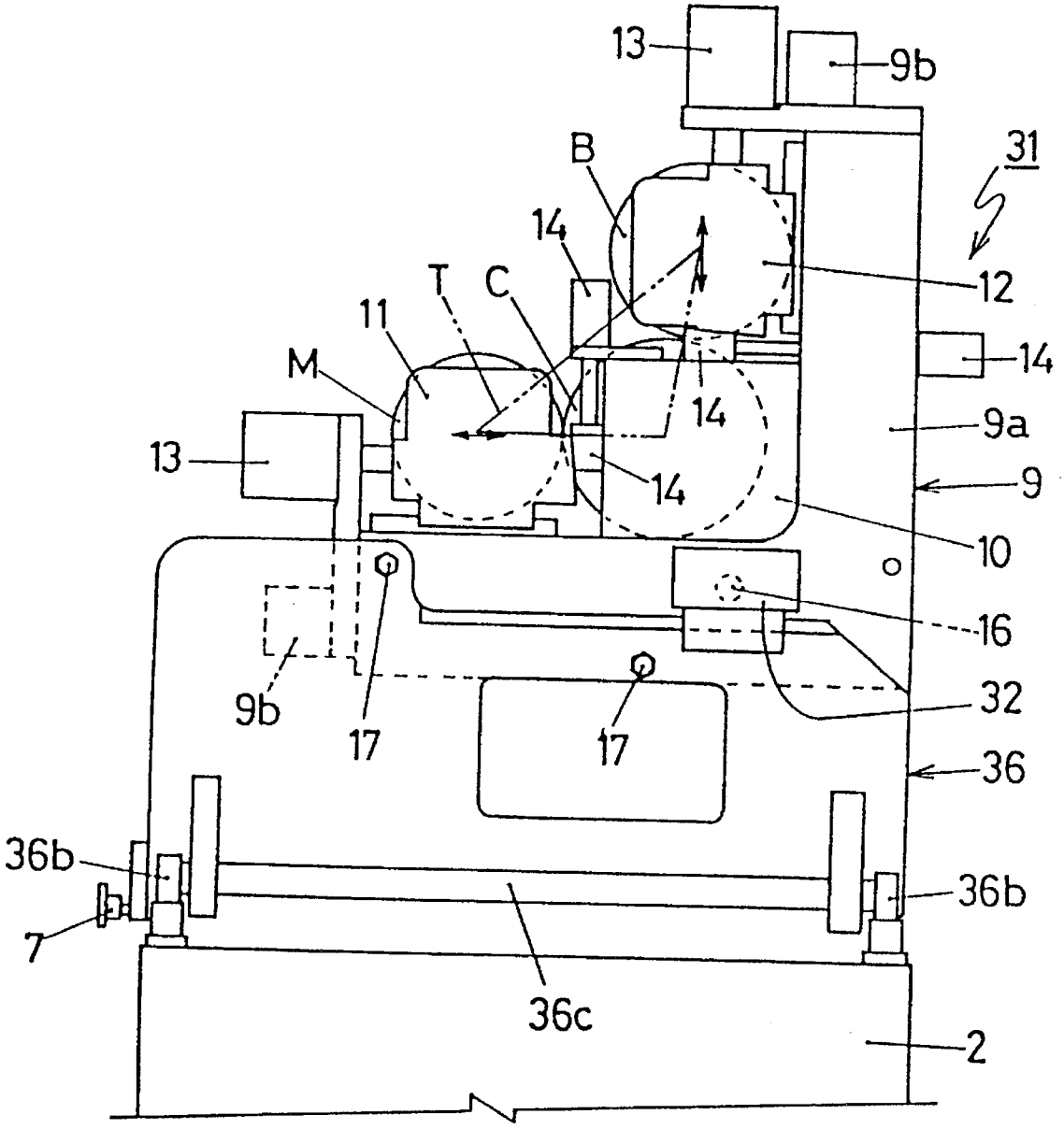
FIG. 8 is a right side view of a coating apparatus according to a second embodiment of the present invention with the imaginary triangle T in its normal position.
Figure 9:
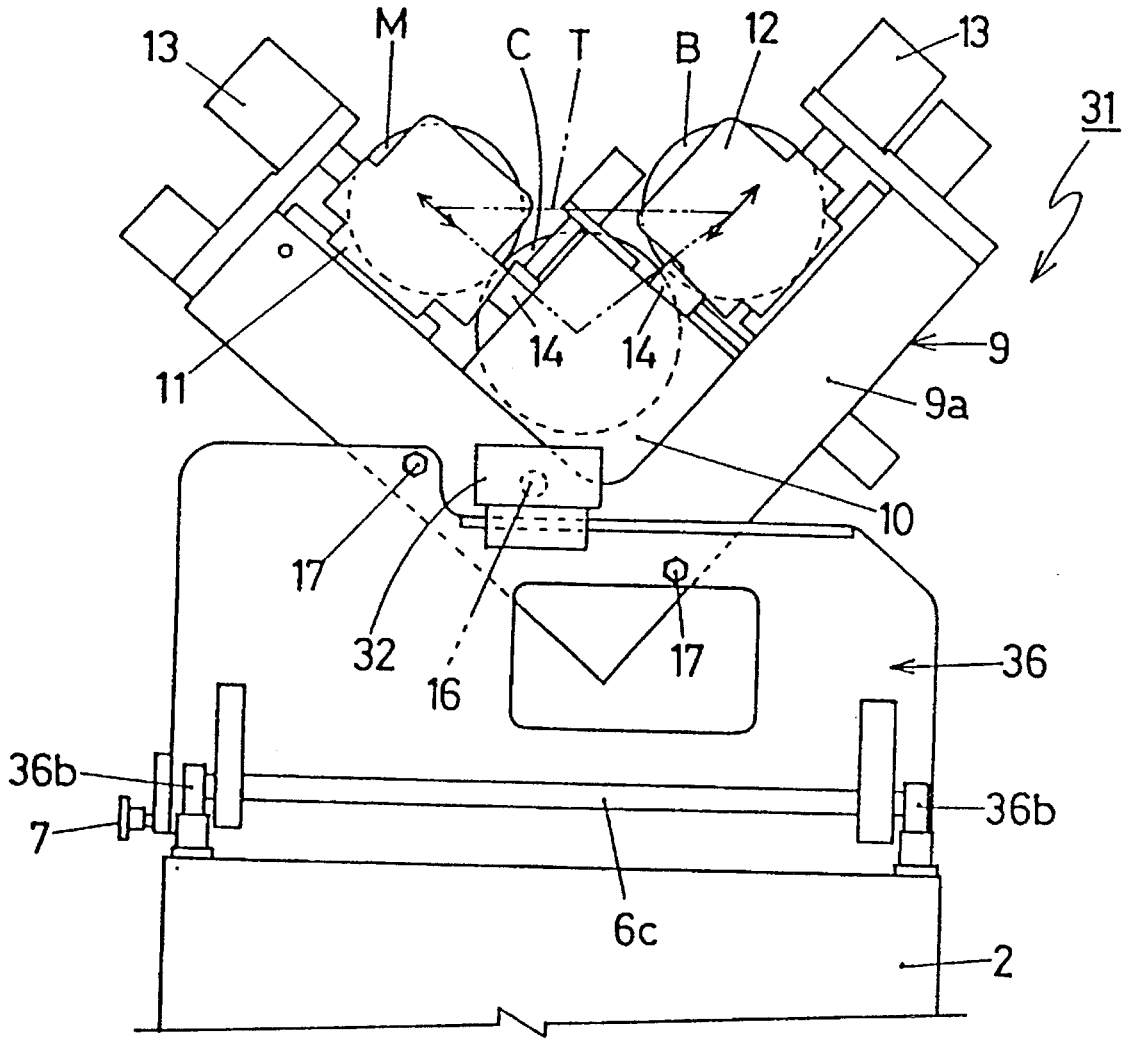
FIG. 9 is a right side view of the coating apparatus shown in FIG. 8, with the imaginary triangle T in its inverted position.

FIGS. 8 and 9 show a coating apparatus according to a second embodiment of the present invention. FIG. 8 is a right side view of the coating apparatus with the imaginary triangle T in its normal position. FIG. 9 is a view similar to FIG. 8, but with the imaginary triangle T in its inverted position.

A coating apparatus 31 of the second embodiment differs from the coating apparatus 1 of the first embodiment in that the swing frame assembly 9 is journaled by a pair of right and left sliders 32. The sliders 32 are mounted to a support frame 36 and movable in a to-and-aft direction. Other than that, the present embodiment is substantially the same as the previous embodiment. The imaginary triangle T is free to rotate as far as the amount of offset between the axes of the rolls C, M and B and output shafts (not shown) is within the allowable offset range of the offset shaft couplings (not shown).

The support frame 36 is in the form of a carrier and includes axles 36*c* with wheels 36*b* and 36*b*. As such, the support frame 36 can be moved to the left on the base frame 2 so as to allow ready replacement of rolls. Alternatively, the support frame 36 may be fixed to the base frame 2.

In the coating apparatus 31, a portion of the swing frame assembly 9 which is journaled by the support frame 36 is located outside of the imaginary triangle T which connects the axes of the three bearings 10, 11 and 12. This arrangement allows the swing frame assembly 9 to be swung without interfering with the offset shaft couplings 24, 25 and 26 (see FIG. 2) which in turn, provide a connection between the shafts of the rolls C, M and B and the output shafts 21*a*, 21*b* and 21*c* (see FIG. 2). The imaginary triangle T is moved back and forth when the swing frame assembly 9 is swung back and forth. Advantageously, the reciprocating movement of the imaginary triangle T can be accommodated by the reciprocating movement of the sliders 32. Thus, the imaginary triangle T can be rotated from the normal position shown in FIG. 8 to the inverted position shown in FIG. 9 as far as the amount of offset between the axes of the rolls C, M and B and the respective output shafts 21*a*, 22*a* and 23*a* is within the allowable offset range of the offset shaft couplings 24, 25 and 26.

(Third embodiment)

Figure 10:
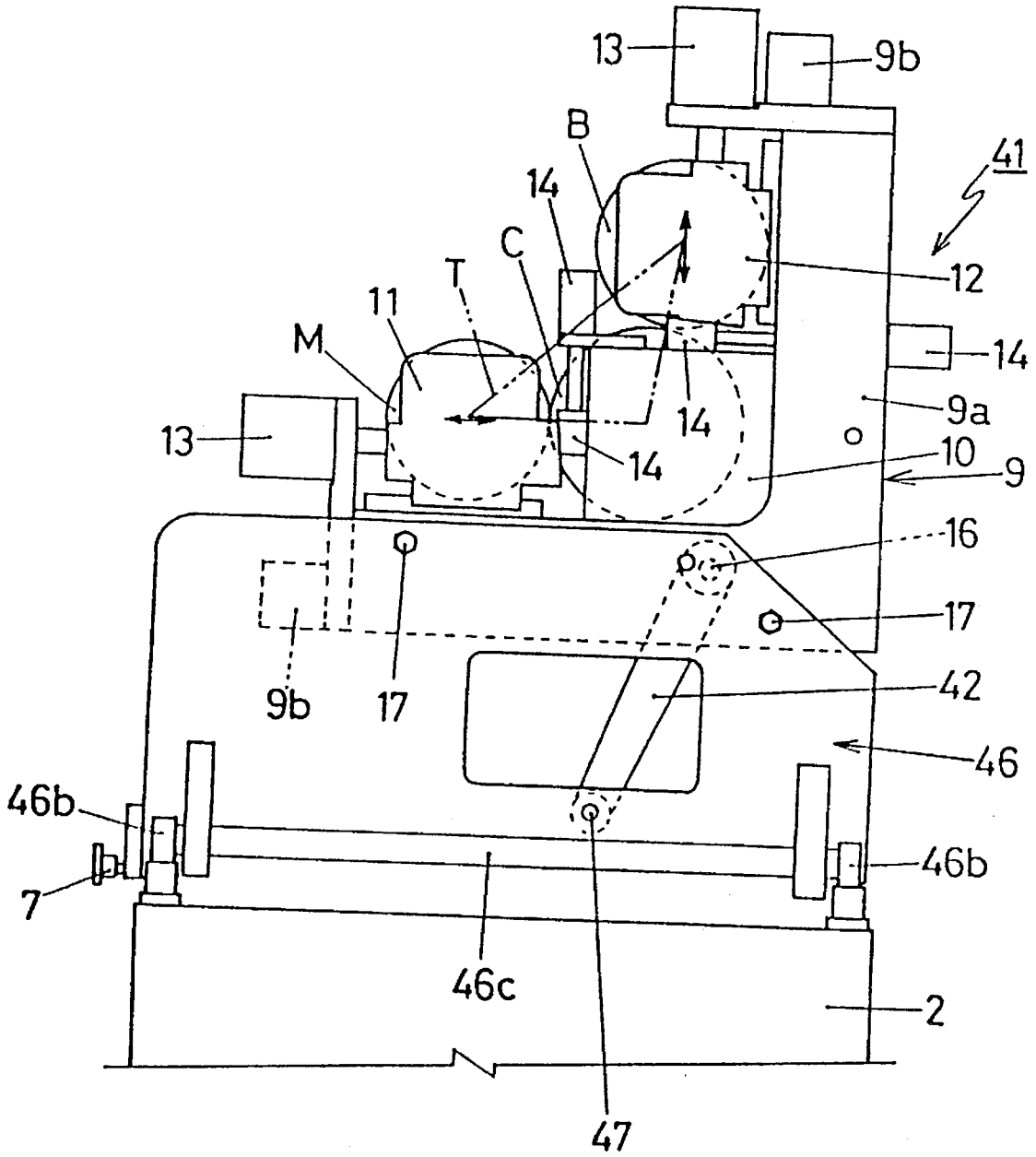
FIG. 10 is a right side view of a coating apparatus according to a third embodiment of the present invention with the imaginary triangle T in its normal position.
Figure 11:
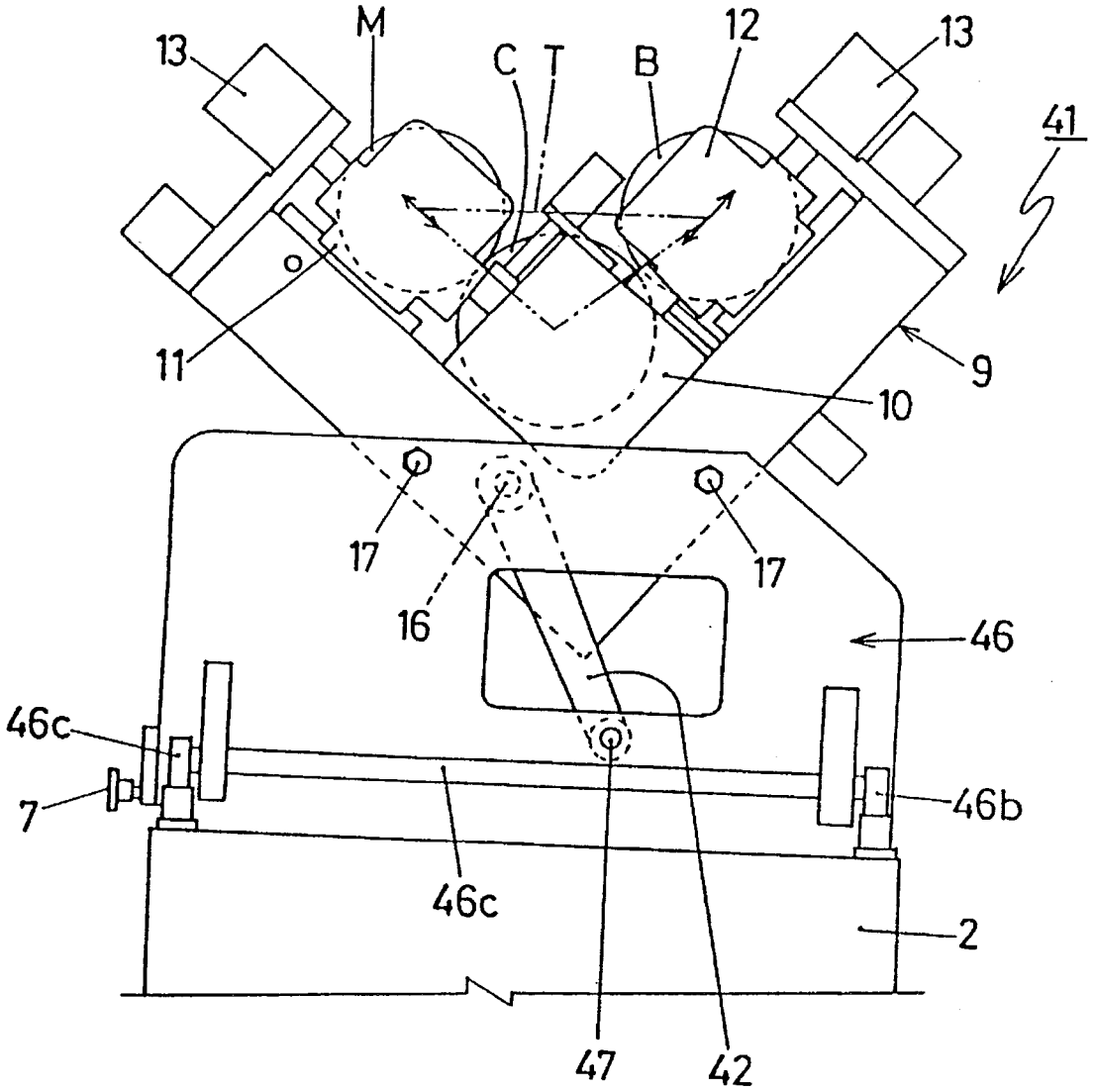
FIG. 11 is a right side view of the coating apparatus shown in FIG. 10, with the imaginary triangle T in its inverted position.
Figure 12A:
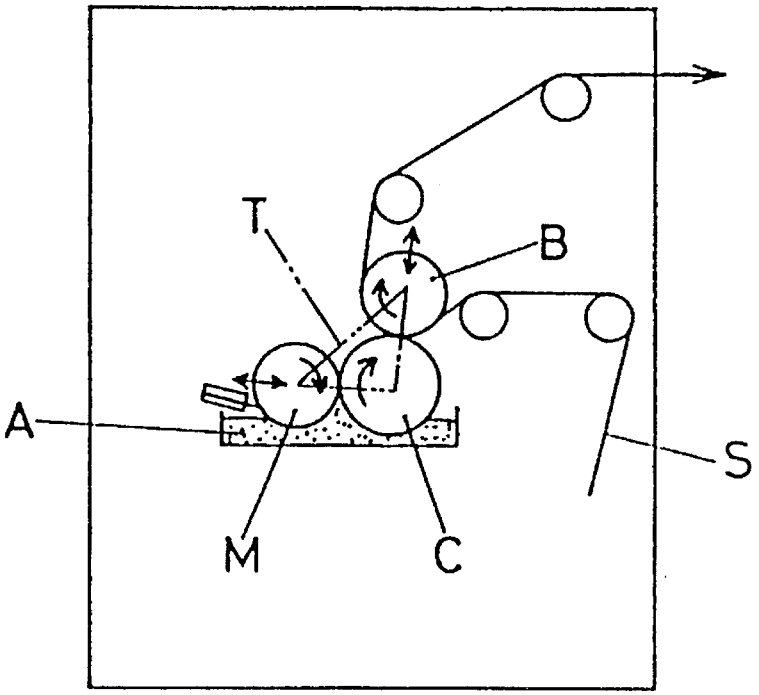
FIG. 12(A) (PRIOR ART)
FIGS. 12(A) and 12(B) schematically illustrate various coating methods performed by conventional coating apparatus.
Figure 12B:
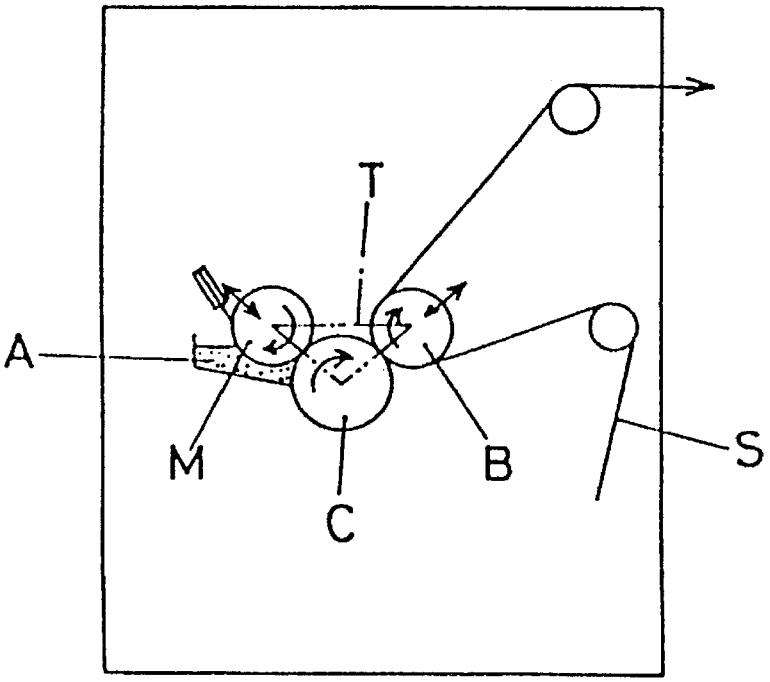
FIG. 12(B) (PRIOR ART)

FIGS. 10 and 11 show a coating apparatus according to a third embodiment of the present invention. FIG. 10 is a right side view of the coating apparatus with the imaginary triangle T in its normal position. FIG. 11 is a view similar to FIG. 10, but with the imaginary triangle T in its inverted position.

A coating apparatus 41 of the third embodiment differs from the coating apparatus 1 of the first embodiment in that the swing frame assembly 9 is pivotally connected as at 16 to first ends of swing levers 42, and second ends of the swing levers 42 are pivotally connected to a support frame 46. Other than that, the present embodiment is substantially the same as the first embodiment. The imaginary triangle T is free to rotate as far as the amount of offset between the axes of the rolls C, M and B and output shafts (not shown) is within the allowable offset range of offset shaft couplings (not shown).

The support frame 46 is in the form of a carrier and includes axles 46*c* with wheels 46*b* and 46*b*. As such, the support frame 46 can be moved to the left on the base frame 2 so as to allow ready replacement of rolls. Alternatively, the support frame 46 may be fixed to the base frame 2.

In the coating apparatus 41, a portion of the swing frame assembly 9 which is pivotally connected as at 16 to the swing levers 42 is located outside of the imaginary triangle T which connects the axes of the three bearings 10, 11 and 12. This arrangement allows the swing frame assembly 9 to be swung without interfering with the offset shaft couplings 24, 25 and 26 (see FIG. 2) which in turn, provide a connection between the shafts of the rolls C, M and B and the output shafts 21*a*, 21*b* and 21*c* (see FIG. 2). The imaginary triangle is moved back and forth when the swing frame assembly 9 is swung back and forth. Advantageously, the reciprocating movement of the imaginary triangle T can be accommodated by swing motion of the swing levers 42. Thus, the imaginary triangle T can be rotated from the normal position shown in FIG. 10 to the inverted position shown in FIG. 11 as far as the amount of offset between the axes of the rolls C, M and B and the respective output shafts 21*a*, 22*a* and 23*a* is within the allowable offset range of the offset shaft couplings 24, 25 and 26.

It is clear from the foregoing description that the coating apparatus of the present invention is able to easily change the orientation of the imaginary triangle so as to perform desired coating methods. Thus, various kinds of coating agents having different viscosities or other properties can be applied by the use of a single apparatus. This results in a decrease in the manufacturing cost and required floor space of the coating apparatus.

While the present invention has been described with reference to the preferred embodiments, it will be understood that many modifications and changes may be made without departing from the spirit and scope of the invention as defined by the appended claims.

What is claimed is:

1. A coating apparatus for applying coating agents having different viscosities to a web of sheet material, comprising:

three pairs of bearings having respective axes which define apexes of an imaginary triangle;

three rolls journaled by said three pairs of bearings, respectively, one of said rolls being a backing roll for engaging the web of sheet material;

means for applying the coating agents to another one of said rolls which cooperates with the web of sheet material on said backing roll for applying the coating agents to the web of sheet material;

drive means including three output shafts at predetermined locations;

three offset shaft couplings for connecting the three rolls to the corresponding three output shafts;

a swing frame to which said three pairs of bearings are mounted, said swing frame having a portion located outside of the imaginary triangle; and a movable frame by which said portion of the swing frame is journaled, said movable frame being movable in a to-and-aft direction, said imaginary triangle being rotatable so far as the mount of offset between said rolls and said output shafts is within an allowable offset range of said offset shaft couplings, whereby the coating agents having different viscosities can be applied to the web of sheet material.

2. A coating apparatus according to claim 1, wherein said movable frame is moved in a transverse direction.

3. A coating apparatus for applying coating agents having different viscosities to a web of sheet material, comprising:

three pairs of bearings having respective axes which define apexes of an imaginary triangle;

three rolls journaled by said three pairs of bearings, respectively, one of said rolls being a backing roll for engaging the web of sheet material;

means for applying the coating agents to another one of said rolls which cooperates with the web of sheet material on said backing roll for applying the coating agents to the web of sheet material;

drive means including three output shafts at predetermined locations;

three offset shaft couplings for connecting the three rolls to the corresponding three output shafts;

a swing frame to which said three pairs of bearings are mounted, said swing frame having a portion located outside of the imaginary triangle;

sliders by which said portion of said swing frame is journaled; and a support frame to which said sliders are so mounted as to move in a to-and-aft direction.

said imaginary triangle being rotatable so far as the amount of offset between said rolls and said output shafts is within an allowable offset range of said offset shaft couplings, whereby the coating agents having different viscosities can be applied to the web of sheet material.

4. A coating apparatus according to claim 3, wherein said support frame is moved in a transverse direction.

5. A coating apparatus for applying coating agents having different viscosities to a web of sheet material, comprising:

three pairs of bearings having respective axes which define apexes of an imaginary triangle;

three rolls journaled by said three pairs of bearings, respectively, one of said rolls being a backing roll for engaging the web of sheet material;

means for applying the coating agents to another one of said rolls which cooperates with the web of sheet material on said backing roll for applying the coating agents to the web of sheet material;

drive means including three output shafts at predetermined locations;

three offset shaft couplings for connecting the three rolls to the corresponding three output shafts;

a swing frame to which said three pairs of bearings are mounted, said swing frame having a portion located outside of the imaginary triangle;

swing levers having first ends and second ends, said portion of said swing frame being pivotally connected to said first ends of said swing levers;

a support frame to which said second ends of said swing levers are pivotally connected, said imaginary triangle being rotatable so far as the amount of offset between said rolls and said output shafts is within an allowable offset range of said offset shaft couplings, whereby the coating agents having different viscosities can be applied to the web of sheet material.

6. A coating apparatus according to claim 5, wherein said support frame is moved in a transverse direction.

* * * * *